United States Patent [19]

Visek et al.

[11] Patent Number: 4,677,952

[45] Date of Patent: Jul. 7, 1987

[54] UNIT FOR COUPLING A DISPLACEABLE OPERATING BAR OR SHAFT WITH A REGULATING MEMBER, IN PARTICULAR WITH AN ADJUSTING ROD OF A FUEL INJECTION AGGREGATE IN AN INTERNAL COMBUSTION ENGINE

[75] Inventors: Tomas Visek; Gottfried Czaby; Georg Nowotny, all of Steyr, Austria

[73] Assignee: Steyr- Daimler-Puch AG, Vienna, Austria

[21] Appl. No.: 801,738

[22] Filed: Nov. 26, 1985

[30] Foreign Application Priority Data

Nov. 27, 1984 [AT] Austria ..... 3750/84
Dec. 11, 1984 [AT] Austria ..... 3918/84

[51] Int. Cl.[4] ..... F02M 59/28
[52] U.S. Cl. ..... 123/372
[58] Field of Search ..... 123/372, 373

[56] References Cited

U.S. PATENT DOCUMENTS 4,557,235 12/1985 Amemori et al. ..... 123/372 X

FOREIGN PATENT DOCUMENTS 364578 10/1981 Austria .
366788 5/1982 Austria .
55245 2/1982 European Pat. Off. .
1622152 12/1970 Fed. Rep. of Germany .
7039614 8/1971 Fed. Rep. of Germany .
3102413 1/1982 Fed. Rep. of Germany .

*Primary Examiner*—Tony M. Argenbright
*Attorney, Agent, or Firm*—Marmorek, Guttman & Rubenstein

[57] ABSTRACT

A unit for coupling a displaceable operating member such as a bar or shaft with a regulating member, in particular a regulating rod of a fuel injection aggregate of an internal combustion engine, comprises a casing and a cam which can be clamped on the operating member, by means of a screw, to project therefrom. This cam which comprises an internally threaded nut engages the regulating member whose movement in one direction is limited by a stop or the like abutting organ. The operating member is provided with a transverse bore which can register with a bore in the casing, and a fixing pin is lodged in the casing bore and the transverse bore when the regulating members are in a basic position. In order to attain automatically the positioning of the cam and the operating member relative to each other, achieved by a basic adjustment, and to provide a relatively simple construction facilitating assembly of the unit, the internal nut threading is designed to be self-locking. The screw extends through the transverse bore of the operating member, and, in doing so, the direction of the force exerted on the cam by the screwing-down momentum of the screw corresponds to the direction of movement of the regulating member towards the stop.

9 Claims, 6 Drawing Figures

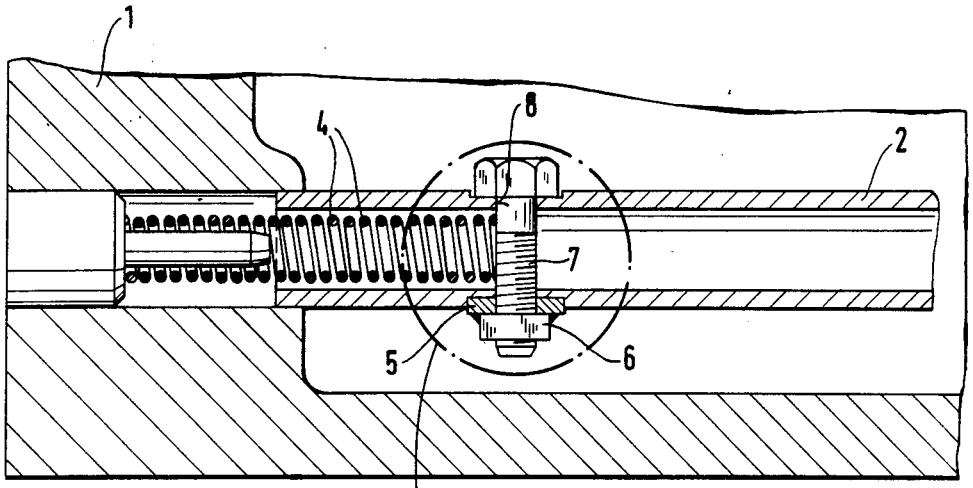
Fig. 2
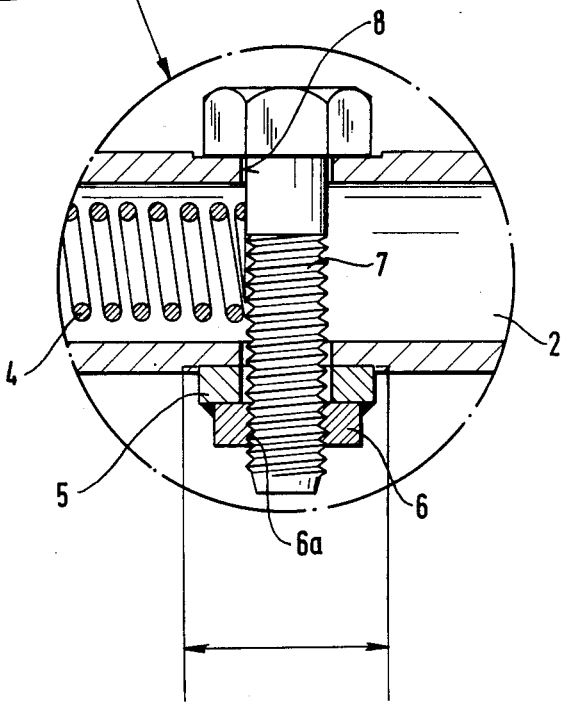

Fig. 5
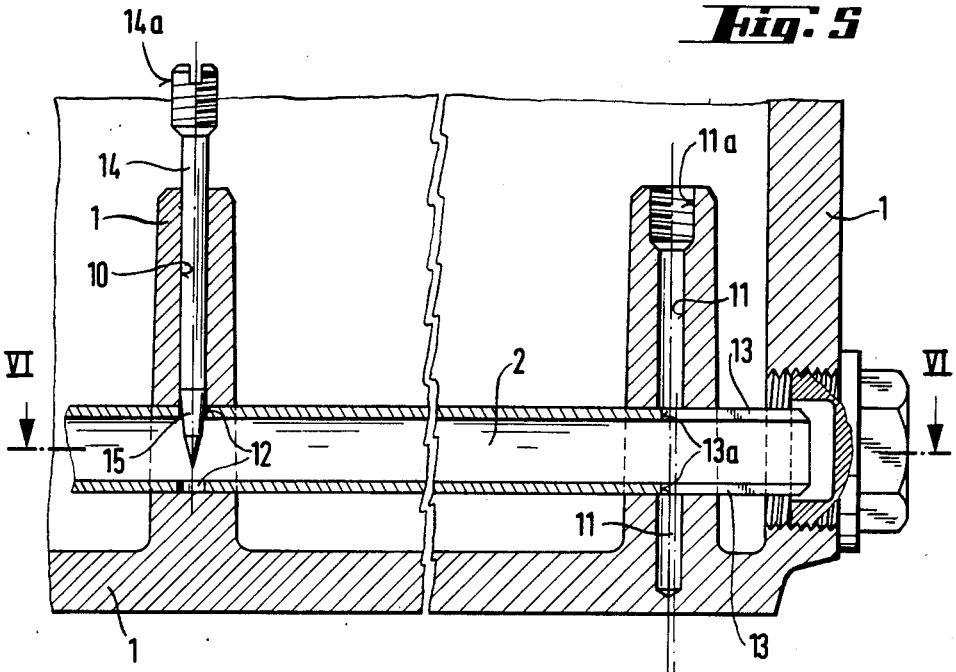
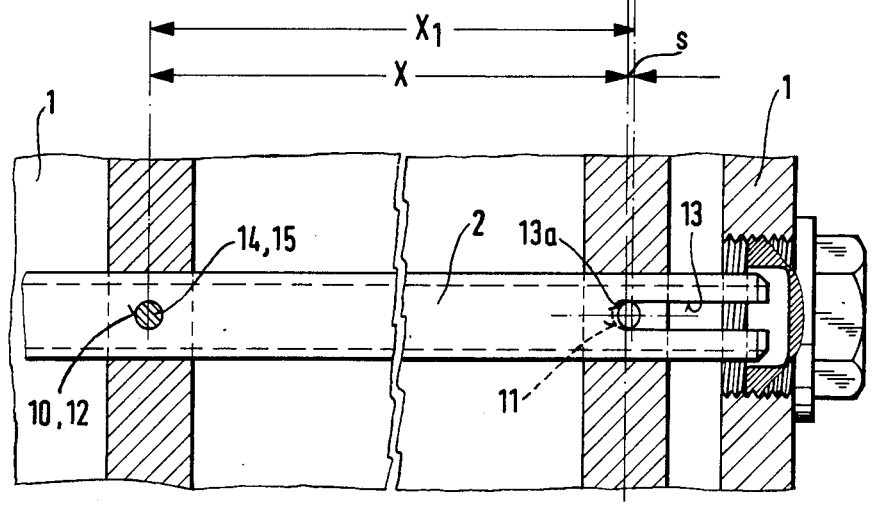
Fig. 6

UNIT FOR COUPLING A DISPLACEABLE OPERATING BAR OR SHAFT WITH A REGULATING MEMBER, IN PARTICULAR WITH AN ADJUSTING ROD OF A FUEL INJECTION AGGREGATE IN AN INTERNAL COMBUSTION ENGINE

BACKGROUND OF THE INVENTION

This invention relates to improvements in a known unit for coupling a displaceable operating member such as a bar or shaft with at least one regulating member, in particular a regulating rod, of a fuel injection aggregate of an internal combustion engine, which unit comprises a unit casing having a bore, a cam adapted for being firmly clamped, by screw means such as a screw bolt, on the operating member to project transversely therefrom, and engaging the regulating member, abutting means such as a stop or the like for limiting the movement of the regulating member in one direction, which cam is provided with nut means having an internal threading for engaging the screw means, the operating member having a first transverse bore being associable with a bore of the said unit casing, and a preferably cylindrical fixing and positioning pin which is adapted for being set, during an initial step of the assembly of the regulating member or members with the operating member, in the last-mentioned unit casing bore as well as in the first transverse bore of the operating member and secures the said operating member against displacement of any kind relative to the casing.

It is essential in such regulating units to achieve an exact initial positioning of the members. Therefore, during assembly, the regulating member must be urged against the abutment means, and the cam must be clamped firmly on the operating bar or shaft in a position such that no play is left between the operating member and the regulating member, and that, moreover, the cam will retain its position, fixed by clamping in the abutting state, in relation to the operating member, as otherwise inaccuracies will occur when the regulating member is subsequently adjusted.

In structures we know to exist in industry the cam comprises a hub having a piercing elongated slot, by means of which hub it is mounted on the operating bar or shaft. By means of the above-mentioned screw the elongated slot is narrowed, thus resulting in a clamping of the cam on the operating member. However, as it is necessary for the hub to possess a certain radial play on the operating bar or shaft, there results a certain tilting of the hub axis vis-a-vis the axis of the operating member when the cam is pressed against the regulating member being in abutting position. During subsequent firm clamping, there results a distorting force which causes a certain springing back or repelling movement of the operating bar or shaft when the respective regulating member is released from its abutting position.

Thereby the initially achieved fine adjustment will not be preserved notwithstanding an effective clamping of the cam on the regulating rod. This drawback becomes particularly important when the operating member bears several cams for the simultaneous adjustment of several regulating members, such as is the case in internal combustion engines having several cylinders and fuel injection aggregates being each individually associated with a different cylinder, respectively, which injection aggregates comprise each a regulating rod, and all of these regulating rods must be shifted simultaneously in operation.

In a unit of the initially described kind disclosed in the European Offenlegungsschrift No. 55 245, the operating bar has an angular profile on which angular cams are mounted. Screws are inserted through holes in the operating bar which clamp the cams fast on the bar by means of nuts. Due to the play of the screw bolts in the holes, and between the cams and the operating bar, it is not possible to attain in this case an exact permanent clamping of the cams on the operating bar relative to the initial or basic position of the parts. Moreover the angular profile of the operating bar gives rise to problems with regard to its support in the unit casing, as the necessary bearings are difficult to manufacture.

OBJECTS AND SUMMARY OF THE INVENTION

It is therefore a primary object of the invention to solve the problem of avoiding the last-mentioned drawbacks by providing a coupling unit of the initially described kind in which the positioning of the cam and the operating member relative to each other attained by the basic adjustment is maintained automatically, and a relatively simple construction facilitating assembly is afforded.

This object is attained and the aforesaid drawbacks are avoided by improvements of the initially described coupling unit which comprise a nut internal threading in the cam being devised as a threading which is self-locking due to an increased screwing-down momentum, a second transverse bore in the operating member through which bore the screw means extend, wherein the direction of the force exerted on the cam by the screwing-down momentum of the screw means corresponds to the direction of movement of the regulating member toward the abutting means.

In the basic or initial positioning, the screwing-down of the screw into the self-locking nut threading results in a torque which causes the cam to act automatically on the regulating member in a manner such that the latter is pressed against the stop or the like abutting means, whereby no preceding manipulations are required to attain the abutting position of the regulating member as the tightening of the screw is sufficient for achieving the same.

In doing so the cam arrives at a corresponding relative position with regard to the operating bar or rod. When screwing down is continued, there will result a fixing of the cam position vis-à-vis the operating member by increased friction contact, as the cam is clamped firmly on the operating member by means of the screw. The self-locking nut threading ensures that the clamping screw connection cannot be loosened. As no pretensioning is effected during this screwing-down step, no reactive forces can occur after the basic adjustment has been completed, i.e. forces which would otherwise cause a displacement of the operating bar or shaft, or a change in the relative positioning of the cam. The construction is very simple as it is only a matter of providing the operating member with a transverse bore, and the cam does not require a hub, but only rests in contact with the operating member. Thus, only a self-locking nut threading is required which is obtained by having it deviate with regard to its pitch, profile, or the cross-sectional shape of the bore from the threading of the screw means, or from the screw means, in particular the screw bolt itself.

A particularly simple and inexpensive embodiment is obtained by punching the cam out of a metal sheet, and fastening the nut containing the self-locking threading thereon by welding, soldering or gluing. This enables the use of commercially available and therefore particularly inexpensive nuts. It is also possible to combine the nut with the punched-out sheet metal part by means of riveting.

The improved unit according to the invention is, of course, also suitable for the coupling of the operating bar or shaft with the regulating means of a fuel injection internal combustion engine. Other suitable fields of application are all those in which two elements which are displaceable are to be coupled for achieving common thrust motion while preserving an exact initial position. Once the basic assembly has been accomplished, the fixing and positioning pin by means of which the operating member is held safely against displacement, is transferred to a second casing bore in which it engages an elongated slot in the operating member and thereby prevents torsional displacement during the operation of the machine, which would otherwise be effected by torques being exerted on the operating bar or shaft by the cams projecting on one side of the bar or shaft. The fixing and guiding pin which serves in its initial position only as an auxiliary element during assembly, is at the same time located in the casing in a manner such that it cannot be lost and is always available for the next basic adjustment. It is recommended to screw the pin down into the second casing bore, to which end it can be provided with its head and with an external threading in order to prevent its loosening and/or its dropping out of the casing during the operation of the machine.

The regulating members of the pump-and-nozzle aggregate must occupy an abutting position during the basic assembly of the unit. However, in order to avoid damaging the same, and in order to maintain them slightly spaced from the abutment means during operation, the distance between the center of the transverse bore and the center of the curvature of the next-adjacent end of the elongated slot can be larger than the center distance of the two casing bores.

BRIEF DESCRIPTION OF THE DRAWINGS

Further objects and advantages of the improved coupling arrangement according to the invention will become apparent from the further description thereof with respect to the accompanying drawings which illustrate a non-limitative preferred embodiment thereof. In the drawings FIG. 2 shows a partially sectional view of a portion of the embodiment shown in FIG. 1 in a plane indicated by II—II in the latter figure;

Figure 1:
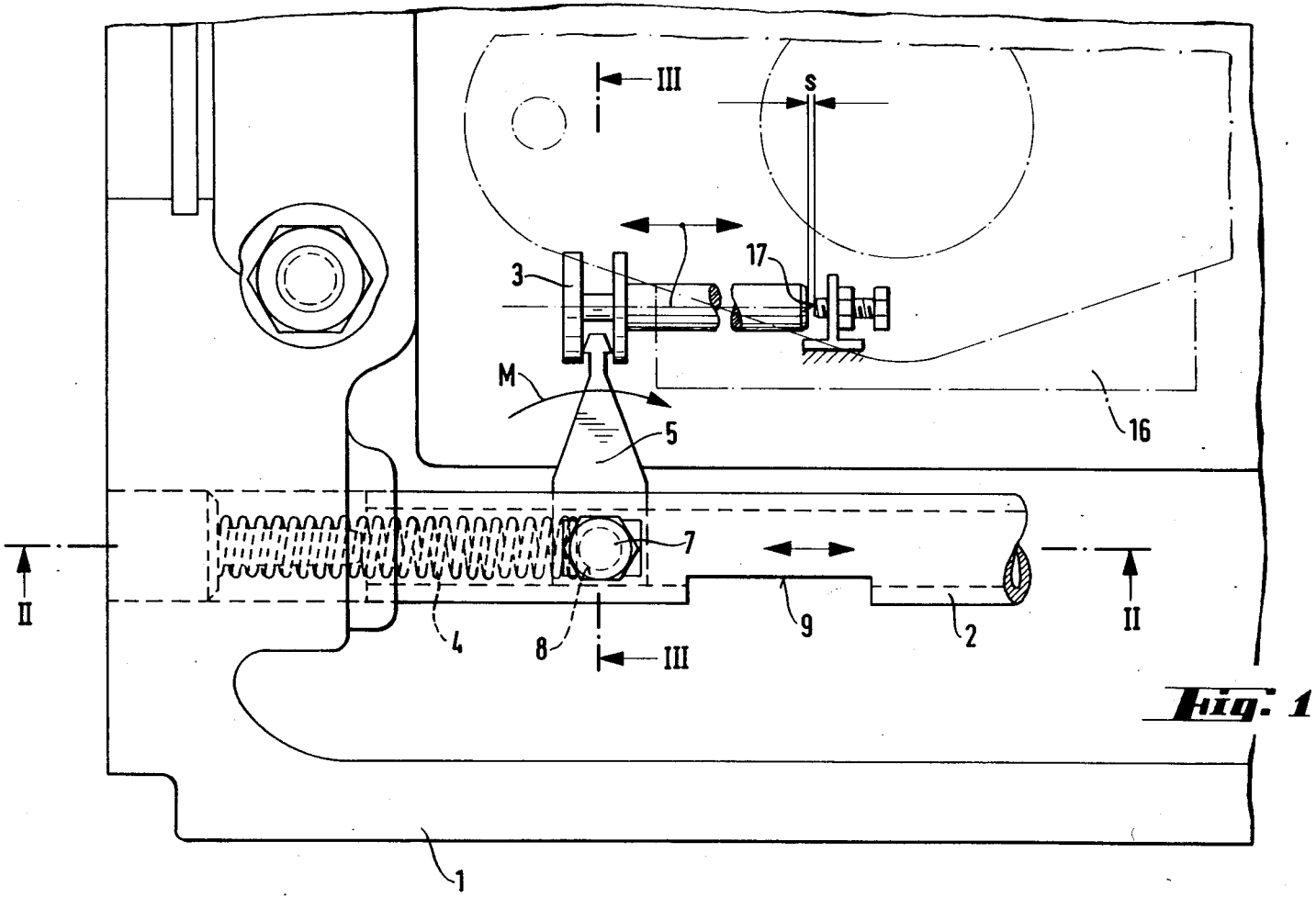
FIG. 1 shows a top view of a unit comprising an operating shaft and a regulating or adjusting rod of a fuel injection pump of an internal combustion engine, with a preferred embodiment of the improvement thereof according to the invention.
Figure 3:
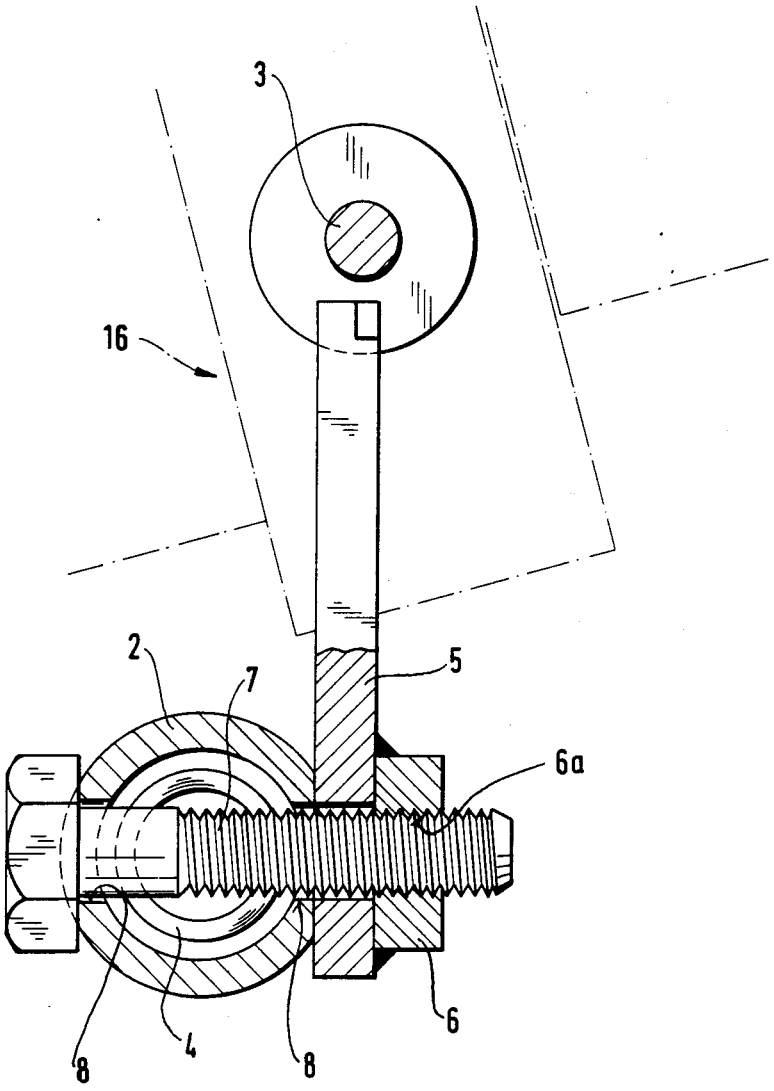
Figure 4:
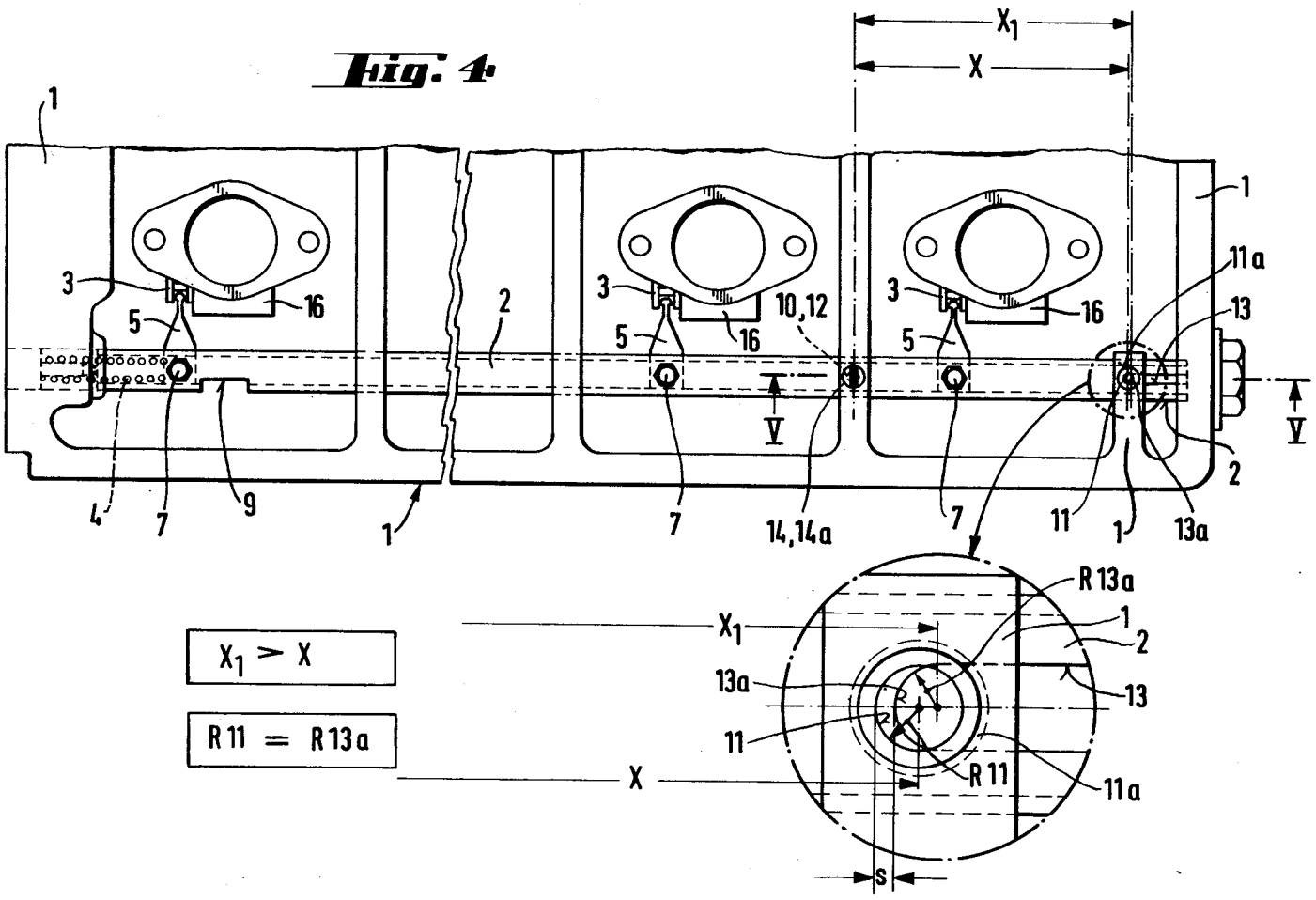

and, in a sideview, an enlarged segment thereof;

FIG. 3 shows schematically a partial cross-sectional view of the same embodiment taken in a plane indicated by III—III in FIG. 1, and in an enlarged scale;

FIG. 4 shows in a top view a part of the unit casing constituting the bearing for the regulating rod in the embodiment of FIG. 1, and, in a sideview, a more detailed segment thereof on a enlarged scale;

FIG. 5 is a vertical sectional view of the embodiment taken in a plane indicated by V—V in FIG. 4; and FIG. 6 is an axial sectional view of the same embodiment taken in a plane indicated by VI—VI in FIG. 5.

DETAILED DESCRIPTION OF THE EMBODIMENT SHOWN IN THE DRAWINGS

In a casing 1 there is lodged an operating shaft or bar 2 for axial displacement therein, which shaft 2 serves for adjusting a respective regulating rod 3 of a fuel injection pump 16. A stop or the like abuttment means 17 is provided for limiting the movement of the regulating rod 3 in one direction, as shown in FIG. 1. In a basic or initial position, the regulating rod 3 must be urged against this stop, or similar abutment means, 17.

In order to couple the operating shaft 2 with the regulating rod 3 there is provided a cam 5 consisting of a punched-out piece of sheet metal, a nut 6 having a self-locking threading **6*a*, being welded on the cam 5 or fastened on the same in another suitable manner, such as by soldering or gluing. The cam 5 is clamped firmly in position on the operating shaft 2 by means of a screw bolt 7, which extends through the shaft 2 in a transverse bore 8**.

The direction of rotation when screwing into place the bolt 7 in the nut 6 is so chosen that this action results in an automatic contact pressure of the regulating rod 3 on the stop 17, i.e. the screwing-down momentum M acts in a direction, indicated by an arrow in FIG. 1, toward the stop 17. The operating shaft 2, which is supported in the casing 1 axially displaceably against the force of a spring 4, serves for the common adjustment of a plurality of regulating rods or toothed racks 3 and is provided with a recess 9 which is destined to be engaged by a governor or the like control means (not shown). Cams 5 are clamped onto the operating shaft 2 and are adapted to engage the regulating rods 3 so as to be coupled therewith.

In the casing 1 there are provided two bores 10 and 11 at a distance from one another. The operating shaft 2 is provided with a transverse bore 12 corresponding to the casing bore 10 and adapted for registering coaxially therewith, and with a terminal elongated, axial slot 13 corresponding to an adapted for registering with the casing bore 11. In the basic or initial position of the regulating rods 3, the operating shaft 2 is firmly held in correct position by means of inserting a fixing and/or guiding pin 14 with its conically tapered end 15 first into the first casing bore 10 and into the shaft transverse bore 12, as illustrated in particular in FIG. 5. After this basic assembly step, the pin 14 is withdrawn and reinserted into the second casing bore 11 and thereby passes through the elongated slot 13, whereby the operating shaft is secured against torsional displacement while being free to be displaced axially. The head of the fixing and/or guiding pin 14 is provided with an external threading **14*a* whereby it can be screwed down firmly in a corresponding internal threading 11*a* in the casing bore 11. The distance $X_1$ between the center of the transverse bore 12 and the center of the curvature described by the radius $R_{13a}$ of the inner end (lefthand end in FIG. 6) zone 13*a*, being nearest thereto, is somewhat larger than center distance X of the two casing bores 10 and 11, whereby the operating bar 2 is urged a short distance (to the left in FIG. 6) toward the casing bore 10 when the pin 14 is inserted in the casing bore 11 and, at the same time, in the elongated slot 13, so that the regulating rods or toothed racks 3 are moved slightly away from the stops 17 which determine their basic positions. In the enlarged sideview of a segment of FIG. 4 there is illustrated the relative position of parts during the basic assembly. There is distinctly visible the relative displacement of the centers of the radii $R_{11}$ and $R_{13a}$, of the bore 11 and the curvature of the closed end of the elongated slot 13, which causes, upon insertion of the pin 14 into the bore 11, an axial shift s of the regulating rods 3 resulting in a very slight distancing by the same length s of the contact end of rod 3 (right-hand end in FIG. 1) from the stop 17**.

We claim:

1. A unit for coupling a displaceable operating member with at least one regulating member of a fuel injection aggregate of an internal combustion engine, comprising a unit casing of a fuel injection aggregate, said unit casing having at least one bore, a displaceable operating member having first and second transverse bores, said first transverse bore being associated with said bore of said unit casing, a regulating member, a positioning pin being insertable into said bore of said unit casing and said first transverse bore of said operating member for securing said operating member against displacement relative to said unit casing, said positioning pin being set during an initial step of assembling said regulating member with said operating member, a cam engaging said regulating member, abutting means for limiting the movement of said regulating member in one direction, screw means for firmly clamping said cam on said operating member and into engagement with said regulating member, said screw means extending through said second transverse bore in said operating member, said cam projecting transversely from said operating member, said screw means having an external threading, and nut means located on said cam, said nut means having an internal threading for engaging said external threading of said screw means, said internal threading of said nut means being self-locking and thereby causing an increased screwing-down momentum, the direction of force exerted on said cam by said screwing-down momentum of said screw means corresponding to the direction of movement of said regulating member toward said abutting means.

2. The unit of claim 1, wherein said internal threading of said nut means deviates from said external threading of said screw means.

3. The unit of claim 2, wherein said internal threading of said nut means deviates in pitch from said external threading of said screw means.

4. The unit of claim 2, wherein said internal threading of said nut means deviates in spiral profile from said external threading of said screw means.

5. The unit of claim 2, wherein said nut means includes a bore, the cross-section of said bore deviating from the cross-section of said screw means.

6. The unit of claim 2, wherein said cam is a punched out piece of sheet metal.

7. The unit of claim 1, wherein said cam and said nut means are joined together by welding.

8. The unit of claim 1, wherein said cam and said nut means are joined together by soldering.

9. The unit of claim 1, wherein said cam and said nut means are joined together by gluing.

* * * * *